US006585012B1

(12) United States Patent
Iovino

(10) Patent No.: US 6,585,012 B1
(45) Date of Patent: Jul. 1, 2003

(54) DEVICE AND METHOD FOR RETAINING PIGMENT TUBES IN A NOZZLE IN A PAINT MIXING MACHINE

(75) Inventor: Frank Iovino, Hickory, NC (US)

(73) Assignee: Ultrablend Color, LLC, Charlotte, NC (US)

( * ) Notice: Subject to any disclaimer, the term of this patent is extended or adjusted under 35 U.S.C. 154(b) by 0 days.

(21) Appl. No.: 10/098,760

(22) Filed: Mar. 15, 2002

(51) Int. Cl.[7] ..... B65B 1/04

(52) U.S. Cl. ..... 141/104; 141/9; 239/600; 222/132

(58) Field of Search ..... 141/2, 18, 9, 100, 141/104; 239/600, 555, 553, 553.3; 222/132, 135, 137, 129.1; 248/75

(56) References Cited

U.S. PATENT DOCUMENTS

| | | | | |
|---|---|---|---|---|
| 2,848,019 A | | 8/1958 | Corbin et al. | 141/100 |
| 3,670,785 A | | 6/1972 | Heiss et al. | 141/9 |
| 4,314,653 A | | 2/1982 | Sindoni | 222/41 |
| 4,403,866 A | | 9/1983 | Falcoff et al. | 366/132 |
| 4,705,083 A | | 11/1987 | Rossetti | 141/104 |
| 5,690,252 A | * | 11/1997 | Oleksiewicz et al. | 222/56 |

* cited by examiner

*Primary Examiner*—Steven O. Douglas
(74) *Attorney, Agent, or Firm*—Kennedy Covington Lobdell & Hickman,LLP

(57) ABSTRACT

A device and method for retaining pigment-conducting tubes in a paint mixing machine includes a nozzle having an array of holes to accommodate the pigment-conducting tubes and a pair of lock plates, attachable to the nozzle and each having a like array of apertures, as well as offset screw holes. When the lock plates are attached to the nozzle and the screw holes are aligned, the apertures are offset, causing deformation of the pigment-conducting tubes, which deformation serves to retain the pigment tubes in the nozzle. A paint mixing machine having pigment reservoirs and valves for controlling pigment flow also has a movable mounting plate, upon which the nozzle is mounted, and the nozzle is thereby movable under microprocessor control between a dormant position and a dispensing position, which, in combination with a sight, allows more precise alignment of a paint can under the nozzle dispensing location.

13 Claims, 4 Drawing Sheets

DEVICE AND METHOD FOR RETAINING PIGMENT TUBES IN A NOZZLE IN A PAINT MIXING MACHINE

FIELD OF THE INVENTION

The present invention relates generally to paint mixing machines and, more particularly, to pigment nozzles, by which pigment is controllably added to a paint container to alter the color of the paint.

BACKGROUND OF THE INVENTION

Most hardware, paint, and general discount stores that sell paint provide it in a wide variety of colors. Because it is highly impractical to offer pre-mixed paint in thousands of colors, these stores stock paint in several base colors and finishes and provide samples or chips of available colors. By selectively adding pigments of up to a dozen or more colors to the base paint, it is possible to provide the customer with the exact color he or she desires.

Formerly, the adding of pigments was accomplished by consulting a formula associating ratios of different pigment colors with the selected sample, manually measuring the pigment, and mixing the pigment into the base color. This method is undesirable insofar as it requires a great deal of manual labor and exactitude in measurement (lest the final color be wrong and the paint wasted), and in high-volume sales operations, the mixing was too time-consuming for impatient customers.

Consequently, the solution has been to utilize an automatic pigment dispensing machine. A set of individually pumped reservoirs of pigment of differing colors is typically connected to a set of valves which, under microprocessor control, direct appropriate amounts of pigment through pigment tubes to a nozzle. A can of base paint is placed under the stationary nozzle. The machine, having been programmed to dispense the proper amount of each pigment, is activated and the pigment is then directed through the nozzle to the paint can. The paint can is capped and agitated, which thoroughly mixes the pigment throughout the base paint and produces paint of the desired color.

There are several attendant problems with the conventional automatic pigment dispensing machine. First, the nozzle is generally exposed to the air when the machine is not in use. If left uncovered and allowed to dry, the nozzle must be cleaned frequently so that a full flow of pigment through the tube is possible. In order to reduce the amount of cleaning that is necessary, it is helpful to utilize a nozzle cap, which is removable from the nozzle either manually or automatically, and which contains a wet sponge. The sponge, in turn, provides the nozzle with a moisture source to keep the nozzle wet over a longer period of time.

Second, the nozzle (and, more particularly, the pigment tubes located within the nozzle) inevitably requires cleaning to remove blockages. Because the pigment tubes are typically only loosely held within the nozzle so as to permit easy removal if replacement is necessary and because conventional retaining means tend to bind the tubes and restrict pigment flow, the removal of blockages, typically performed with an elongate member such as a wooden toothpick or a straightened paper clip, can result in the tube being inadvertently removed from the nozzle or mis-seated within the nozzle at an improper depth. This mis-seating can result in the tube touching the sponge, which causes smearing of the pigment onto and contamination of the sponge, or in the tube failing to extend far enough through the nozzle, which may prevent the proper amount of pigment from being placed into the base paint and result in improper mixing and wasted paint.

Third, because the nozzle is held stationary above an alcove for the paint can, it is difficult to align the paint can directly under the nozzle, particularly when the paint can is of a small size.

What is needed, therefore, is a paint mixing apparatus that includes a cappable nozzle, which retains the tubes against accidental displacement without undue pinching or flow restriction, and which nozzle is movable from a capped, dormant position, to a dispensing position so as to permit easy alignment of the paint can under the nozzle dispensing position.

OBJECT AND SUMMARY OF THE PRESENT INVENTION

In accordance with the above-described need, the object of the present invention is to provide for a means by which the pigment tubes in a paint mixing machine may be easily retained within the nozzle against accidental displacement, either during cleaning or movement of the nozzle, in which system the nozzle is movable between a dormant position and a dispensing position to permit the paint can to be more easily aligned with the nozzle dispensing position.

In order to meet this object, the present invention includes a nozzle comprising an array of holes each having a diameter sufficiently large to accommodate a pigment-conducting tube therein, the array being arranged to form a compact outlet for pigment. The invention further includes a first lock plate that is attachable to the nozzle and includes a first array of apertures that are arranged similarly to the holes in the nozzle, such that each aperture has a diameter sufficiently large to accommodate a pigment-conducting tube therein. A second lock plate is likewise attachable to the nozzle and includes a second array of apertures as in the first lock plate, arranged similarly to the holes in the nozzle. The first and second lock plates each include a pair of screw holes, through which a screw (or other appropriate means) may be used to attached the lock plates to the nozzle once the tubes have been placed through the lock plates and into the nozzle. These first and second lock plates are virtually identical, but they differ in a key respect. When the edges of the lock plates are aligned, the apertures in the plates are likewise aligned and permit a tube to be inserted therethrough, while the screw holes are offset. When the screw holes are aligned to permit attachment of the plates to the nozzle, the apertures are slightly offset, which serves slightly to deform any pigment tubes placed therethrough such that displacement of the tubes from the nozzle is substantially prevented.

In order to facilitate the attachment, the screw holes have a substantially greater diameter than the screw, but a washer having an outer diameter substantially equal to the screw holes and a beveled outer edge is inserted into the screw holes such that, as the screw is driven into the nozzle, screw holes are forced into alignment. In order to provide relief to the pigment tubes as they are retained within the lock plates, each aperture may be provided with one or more notches on its circumference, which enables the tube to be retained while reducing the flow restriction on the tube.

Because the pigment tubes are retained within the nozzle, the nozzle may be made movable between a dormant position and a dispensing position, thus permitting more precise alignment of a paint can under the nozzle dispensing position. Such movement may be controlled manually or by a microprocessor.

The present invention also provides for a paint mixing machine comprising an individually pumped reservoir of pigment, a valve for controlling the flow of pigment through pigment tubes, and a nozzle substantially as described above. The valve and nozzle are mounted on a mounting plate, which is movable between a dormant position and a dispensing position. At the dormant position, the nozzle is positioned over a cap, which prevents drying of pigment within the pigment tube. An optional sight comprises a hole in the mounting plate of substantially the same shape as the nozzle, which sight is positioned in the mounting plate such that when the mounting plate is in the dormant position, the position of the sight is identical to the position of the nozzle when the mounting plate is in the dormant position. A microprocessor may be employed to control the movement of the mounting plate, valve, and nozzle, as well as the actuation of the valve. Advantageously and preferably, a number of like valves, reservoirs, and pigment tubes are provided and connected within the lock plates and nozzle, and all are individually controlled by the microprocessor.

Also within the scope of the invention is a method of retaining a pigment tube within a nozzle using a pair of lock plates each including pair of attaching locations and an offset aperture in a paint pigment dispensing apparatus, which method includes the steps of aligning the apertures of the lock plates, placing the pigment tube through the aligned apertures, inserting the pigment tube into the nozzle, aligning the attaching locations of the lock plates, attaching the lock plates to the nozzle, and creating an offset between the apertures to deform the pigment tube and substantially to prevent its removal from the nozzle.

BRIEF DESCRIPTION OF THE DRAWINGS

Further features, embodiments, and advantages of the present invention will be apparent from the following detailed description with reference to the drawings, wherein.

DETAILED DESCRIPTION OF THE PREFERRED EMBODIMENTS

Figure 1:
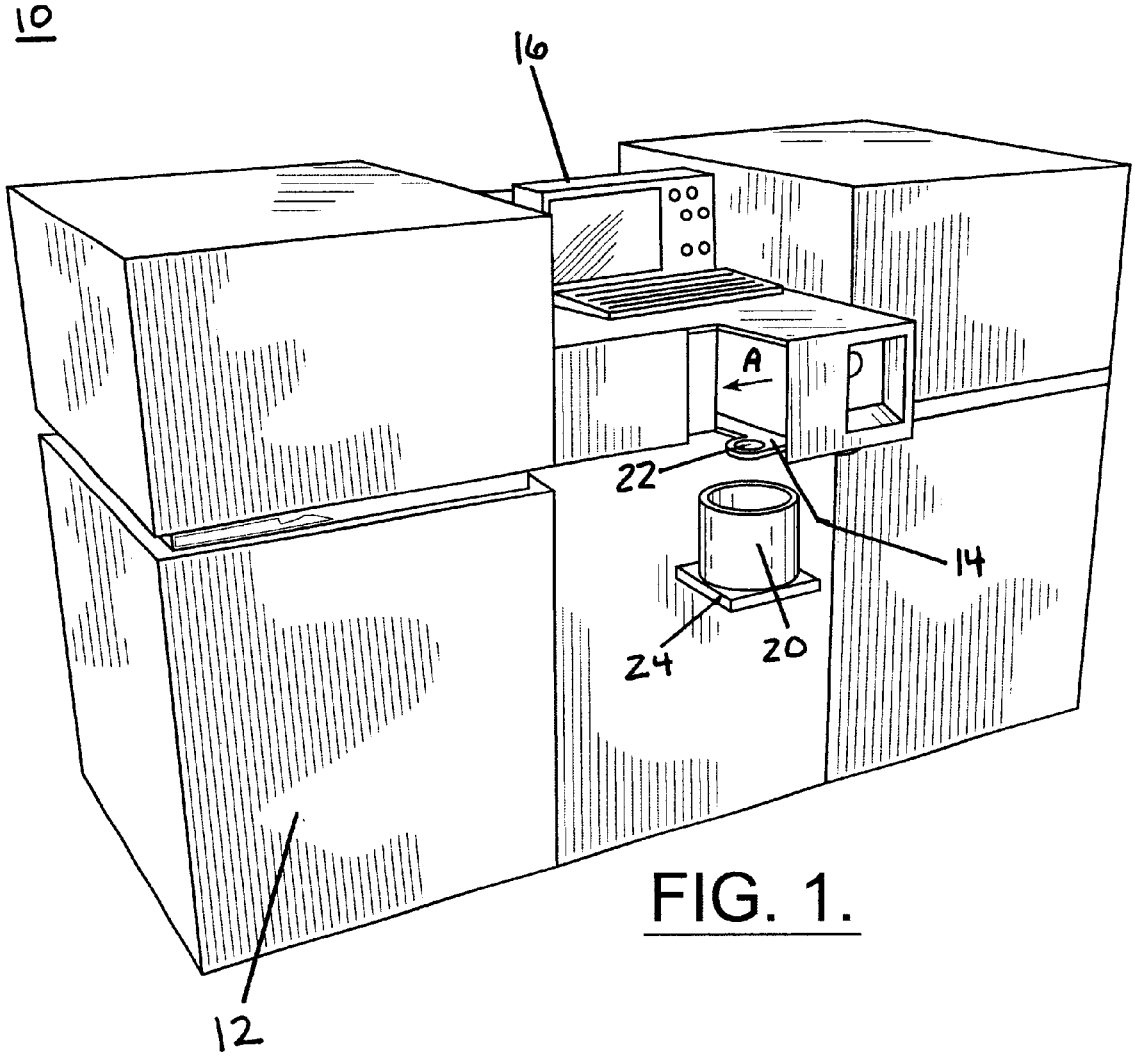
FIG. 1 is a generalized perspective view of an automatic paint mixing machine.

Referring now to FIG. 1, an automatic paint mixing machine 10 is depicted in a general perspective view. A paint can 20 contains base paint ready for tinting with pigment, which is delivered by the operation of the automatic paint mixing machine 10. Frame 12 serves as a mounting location for a number of pigment reservoirs (see FIGS. 5A–5B), which are individually pumped and deliver pigment for dispensing, as well as for the remaining components of the present invention. A movable mounting plate 14 is connected to the frame 12 and serves as a platform for mounting further components of the automatic paint mixing machine, which will be described in greater detail below. A microprocessor-based computer 16 controls several aspects of the delivery of pigment which will likewise be discussed in greater detail below.

The mounting plate 14 is driven between a dormant position (depicted in FIG. 1) and a dispensing position (shown schematically in phantom in FIGS. 5A–5B) in the direction of arrow A. When the mounting plate 14 is in the dormant position, sight 22, which is preferably formed as a hole in mounting plate 14, is positioned above the paint can 20. The primary function of the sight 22 is to permit the operator of the machine to have a reference point for placement of the paint can 20 so that pigment is reliably delivered thereto. In the preferred embodiment, sight 22 is a hole having a footprint at least as large as that of the nozzle, which will be described in greater detail below. Shelf 24 is preferably designed to be of sufficient size and strength to accommodate at least a standard one-gallon paint can and preferably as wide a range of paint containers as are reasonably likely to be used in conjunction with the machine 10, and in fact may be adjustable to accommodate containers as necessary. In the preferred embodiment, the operator places the paint can 20 on the shelf 24 and ensures that the mouth of the paint can 20 or, in some embodiments, a bunghole in the can lid, is aligned with the sight 22.

Although in the present embodiment the sight 22 is formed as a hole in the mounting plate 14, a variety of different types of sights are possible without departing from the scope of the present invention, and it is particularly possible to employ an automatic sight without departing from the scope of the present invention.

In order to dispense pigment of varying colors in precise amounts to produce a custom paint color, the operator then inputs commands into the computer 16, which controls dispensing according to the selected commands.

Figure 2:
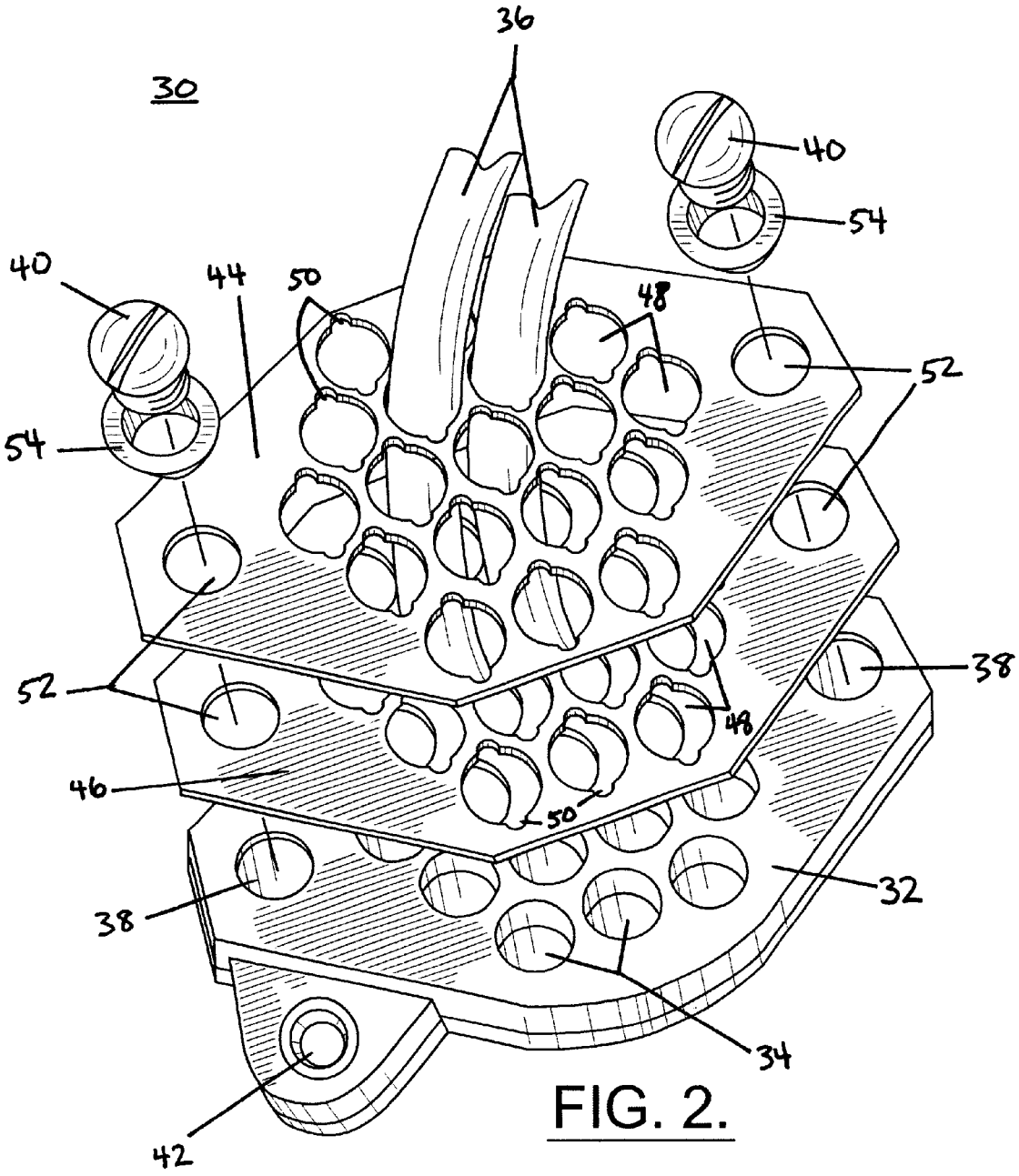
FIG. 2 is a detail view of a nozzle system according to the present invention, with the parts thereof in exploded relation.

Referring now to FIG. 2, a nozzle system 30 according to the present invention is depicted in a detail view with the parts thereof in exploded relation. A nozzle 32 forms the base of the nozzle system 30 and includes an array of holes 34 therein. Each of the holes 34 has a diameter that is sufficiently large to accommodate a pigment-conducting tube 36. The array of holes 34 is preferably grouped to provide as compact an outlet as possible so that pigment may dispensed into small cans or through bungholes into larger containers, if desired. The holes 34 are formed so that they extend entirely through the nozzle 32. The nozzle 32 is also provided with recesses 38, which serve as mounting locations for the screws 40 to be used in connection with the locking mechanism. The nozzle 32 is further provided with means for attaching the nozzle to the mounting plate, such as additional screw holes 42, so that the nozzle system 30 is moved co-operationally with the mounting plate 14.

The pigment-conducting tubes 36 are formed of a pliable material, such as a plastic, which enables the tubes 36 to be directed and deformed as needed. Ideally, the tubes 36 are of sufficient radial strength to withstand deformation without collapsing, so that during deformation (as described below) the flow of pigment therethrough is not restricted.

A first lock plate 44 and a second lock plate 46 are formed, preferably from metal or hard plastic, to have a footprint similar to the nozzle. Each lock plate 44,46 has an array of apertures 48 therein, which are similar in number, size, and arrangement to the holes 34 in the nozzle 32. The apertures 48 are preferably formed with one or more notches 50, which serve a purpose to be described in detail below. Each lock plate 44,46 is further provided with a pair of screw holes 52, and other than in the placement of these screw holes 52, the lock plates 44,46 are preferably identical in all respects. However, when the apertures 48 in the lock plates 44,46 are aligned, the screw holes 52 are slightly offset from one lock plate to the other, and when the screw holes 52 in the lock plates 44,46 are aligned, the apertures 48 are slightly offset from one lock plate to the other. The screw holes 52 in the lock plates 44,46 are preferably formed to be somewhat larger than is necessary to accommodate a screw 40. A pair of washers 54 and screws 40 are provided to complete the assembly.

Figure 3A:
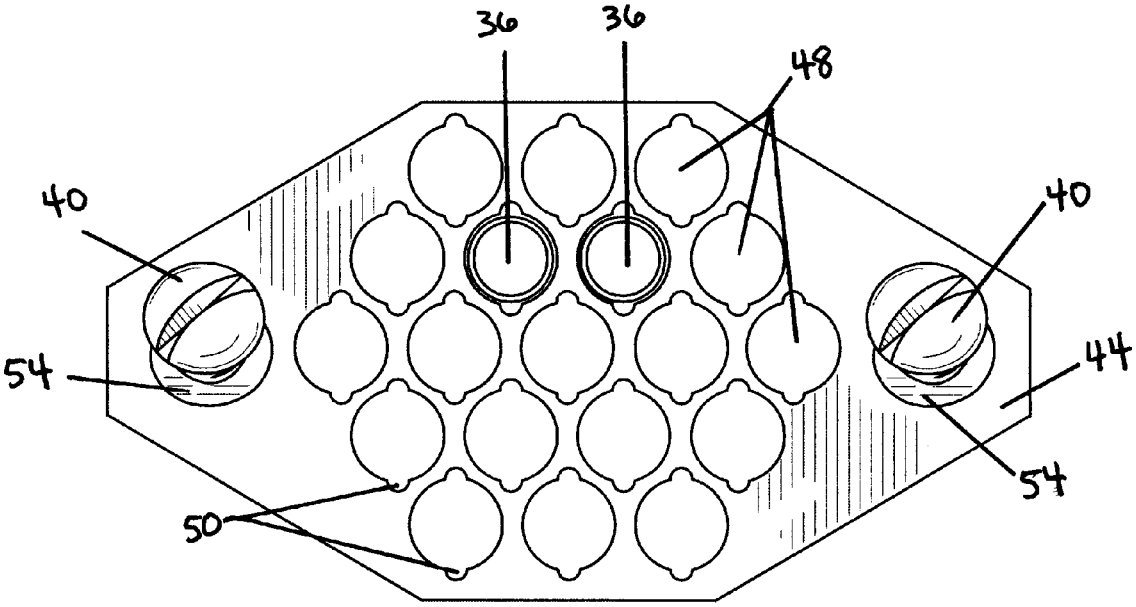
FIG. 3A is a top view of unattached lock plates with aligned apertures according to the present invention.
Figure 3B:
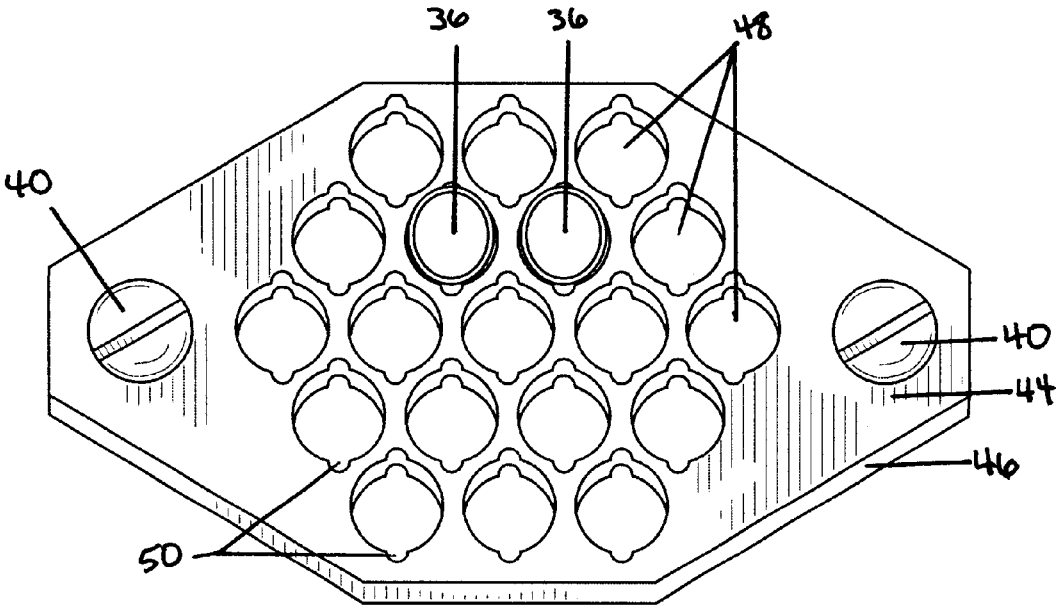
FIG. 3B is a top view as in FIG. 3A, but with attached lock plates and offset apertures.

Referring now to FIGS. 3A–3B, a top view of the lock plates 44,46 is shown first with the apertures 48 aligned (FIG. 3A) and second with the apertures 48 offset (FIG. 3B). During assembly of the nozzle system 30, the apertures 48 in the lock plates 44,46 are aligned. Each of the pigment-conducting tubes 36 is placed through an aperture 48 in the first lock plate 44, through a corresponding aperture 48 in the second lock plate 46, and into and through a corresponding hole 34 in the nozzle 32, to the desired depth. After all of the pigment conducting tubes 36 have been so placed, a washer 54 is placed in the offset screw holes 52 in the lock plates 44,46. Each washer 54 is preferably formed as the frustum of a cone, such that its outer diameter at its lower edge is smaller than its outer diameter at its upper edge, and its outer diameter is sufficiently small so that the washer 54 may be seated within the offset screw holes 52. As the screws 40 are driven into place, the beveled edge of each of the washers 54 forces the screw holes 52 to align, which in turn causes the apertures 48 to offset. In this manner, the pigment-conducting tubes 36 are deformed slightly, which serves to hold the pigment-conducting tubes 36 in place without collapsing them.

Those skilled in the art will recognize that a variety of connection mechanisms other than screws 40 are possible, as long as the required offset in the apertures 48 is produced.

Figure 4:
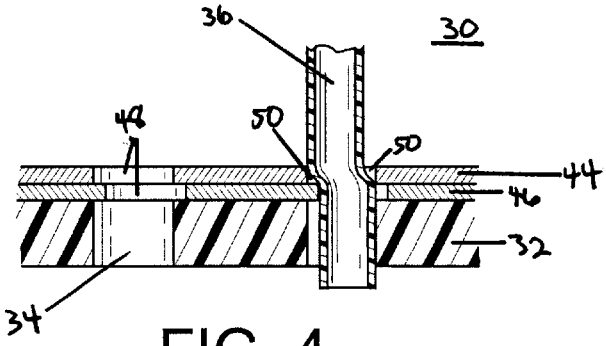
FIG. 4 is a cross-sectional view depicting deformation of a pigment tube according to the present invention.

Referring now to FIG. 4, a partial cross-section of the nozzle system 30 is shown with deformation of the pigment-conducting tube 36 depicted in an exaggerated manner. The offset of the apertures 48 created by the alignment of the screw holes 52 during attachment serves to deform the pigment-conducting tube 36 so as to prevent the tube 36 from being withdrawn from the nozzle 32. This enables the tube 36 to be cleaned, as necessary, by accessing it from the underside of the nozzle 32, without requiring its removal from the nozzle 32 or permitting accidental displacement therefrom.

As noted above and most clearly depicted in FIGS. 2–3B, each of the apertures 48 in the lock plates 44,46 is provided with at least one notch 50. Referring again to FIG. 4, the notches 50 serve to relieve, to some degree, the tension created during deformation by permitting the tube 36 a degree of space into which it may deform. These notches 50, while optional, help to prevent collapse of the tubes 36 and reduce the degree to which flow of the pigment through the tubes 36 is restricted by the locking operation.

Figure 5A:
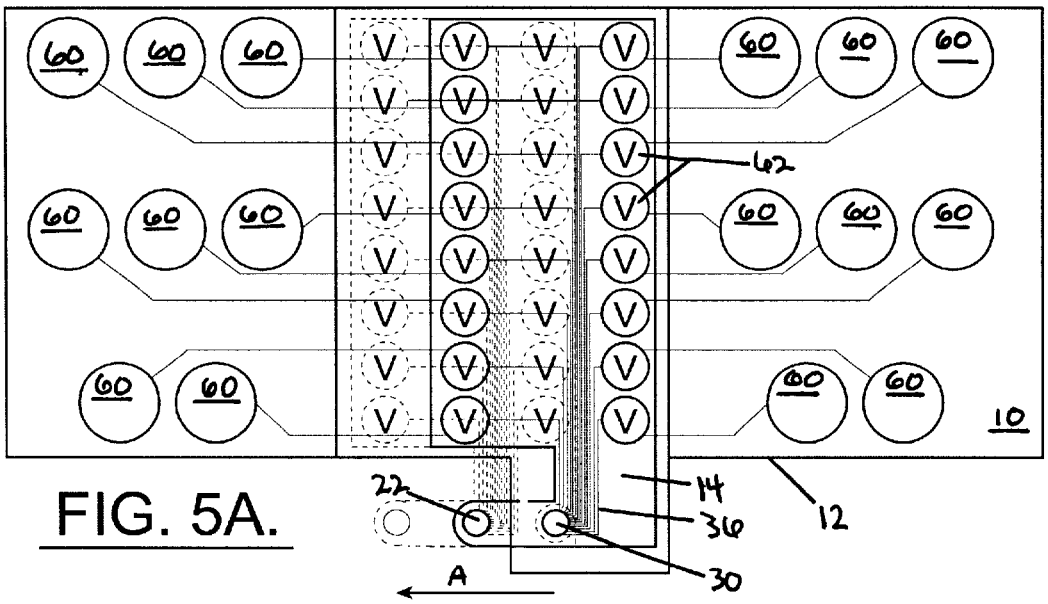
FIG. 5A is a top schematic view of a paint mixing machine according to the present invention, with solid lines depicting the dormant position and broken lines depicting the dispensing position of the mounting plate.
Figure 5B:
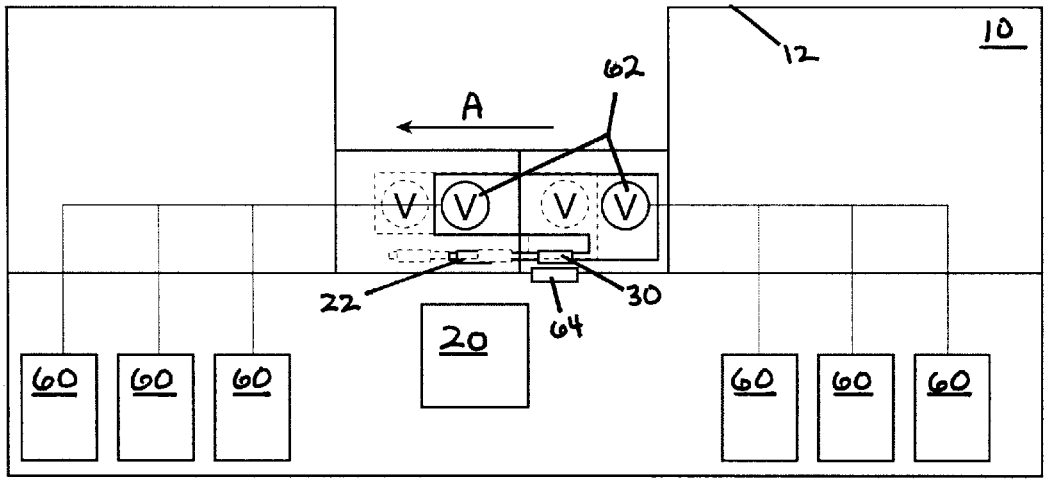
FIG. 5B is a side schematic view of the machine as in FIG. 5A.

Referring now to FIGS. 5A–5B, a paint mixing machine 10 according to the present invention is depicted schematically. A frame 12 provides a mounting location for pigment reservoirs 60 and for a mounting plate 14. The pigment reservoirs 60 are individually pumped to maintain a constant flow of pigment. Mounted on the mounting plate 14 (or, alternatively, to the frame 12) is a set of valves 62, each of which controls the flow of pigment from a pigment reservoir 60 through a pigment-conducting tube 36 to the nozzle 30. Each valve 62 is preferably a bi-directional valve having a single inlet, through which pigment is delivered from the associated pigment reservoir 60, and two outlets, one of which returns the pigment flow to the pigment reservoir 60, and the other of which directs pigment flow to and through the pigment-conducting tubes 36 to the nozzle 30. A microprocessor 16 (see FIG. 1) controls the operation of the valves 62 in accordance with commands consistent with providing a defined amount of pigment of each color necessary to produce paint of the desired color. Specifically, each valve 62 is actuated to dispense pigment to the nozzle 30 for an amount of time that is dependent upon the amount of pigment needed and the viscosity of the particular pigment selected.

In order to dispense the pigment into the paint can 20, it is necessary for the mounting plate 14, which carries the valves 62, the nozzle 30, and the sight 22, to be driven from the dormant position (represented in solid) to the dispensing position (represented in phantom). As can be most clearly seen in FIG. 5B, the position of the sight 22 when the mounting plate 14 is in the dormant position is the same as the position of the nozzle 30 when the mounting plate 14 is in the dispensing position. This enables the sight 22 to be used to align the paint can 20 directly under the dispensing location of the nozzle 30 to prevent spillage and the consequent waste of pigment and paint. Also visible in FIG. 5B is a cap 64, which contains a wet sponge (not shown), and which is positioned under the nozzle 30 when the mounting plate 14 is in the dormant position. The cap 64 is attached to the frame 12 rather than to the mounting plate 14 and therefore remains stationary when the mounting plate 14 moves to the dispensing position. The cap 64 and sponge provide moisture to the nozzle 30 to keep the ends of the pigment-conducting tubes 36 from drying out too quickly, which in turn reduces the degree to which dried pigment must be removed from the tube ends.

Also within the scope of the invention is a method of retaining a pigment tube 36 within a nozzle 32 using a pair of lock plates 44,46, substantially as described above, in a paint pigment dispensing apparatus 10. First, the apertures 48 of the lock plates 44,46 are aligned, and the pigment tube 36 is placed through the aligned apertures 48. The pigment tube 36 is then seated in the nozzle 32, and the screw holes 52 are aligned as the lock plates 44,46 are attached to the nozzle 32. As the screw holes 52 are aligned, an offset between the apertures 48 is created so as to deform the pigment tube 36, whereby the pigment tube 36 is substantially prevented from being removed from the nozzle 32.

This method of retaining the pigment tube 36 is particularly useful when, as in the present invention, the nozzle system 30 is to be moved from a dormant position to a dispensing position, because the pigment tubes 36 are prevented from withdrawing from the nozzle 32 despite this motion.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for retaining one or more pigment-conducting tubes in a paint mixing machine, comprising:

a nozzle comprising an array of holes each having a diameter sufficiently large to accommodate a pigment-conducting tube therein, the array being arranged to form a compact outlet for pigment;

a first lock plate attachable to the nozzle and comprising a first array of apertures arranged similarly to the holes in the nozzle, each aperture having a diameter sufficiently large to accommodate a pigment-conducting tube therein, and further comprising at least two first attaching holes;

a second lock plate attachable to the nozzle and comprising a second array of apertures arranged similarly to the holes in the nozzle, each aperture having a diameter sufficiently large to accommodate a pigment-conducting tube therein, and further comprising at least two second attaching holes identical in size to the first attaching holes and arranged on the second lock plate such that when the first and second attaching holes are mutually aligned, the first and second arrays of apertures are laterally offset and, when the one or more pigment-conducting tubes are placed individually in a first and a second aperture and a hole in the nozzle and the first and second lock plates are attached to the nozzle, the one or more pigment-conducting tubes are substantially prevented from being removed from the nozzle.

2. The device of claim 1, wherein each of the apertures comprises at least one notch in its circumference.

3. The device of claim 1, wherein the nozzle is movable between a dormant position and a dispensing position.

4. The device of claim 3, comprising a microprocessor for controlling movement of the nozzle in accordance with a dispensing command.

5. A device for selectively dispensing pigment in conjunction with custom paint mixing, comprising:

a pumped pigment reservoir, connected to a pigment outlet to deliver a supply of pigment;

a mounting plate movable between a delivery position and a dormant position; a valve comprising an inlet and a pair of outlets, the inlet receiving the supply of pigment, one of the outlets returning the supply of pigment to the pigment reservoir, and the other of the outlets delivering the supply of pigment to a delivery location, wherein the valve is selectively actuable to return or to deliver the supply of pigment; a nozzle mounted on the mounting plate and movable therewith between the delivery position and the dormant position, adapted to receive a pigment tube for directing pigment from the valve;

first and second lock plates each comprising an aperture for receiving the pigment tube and attachable through screw holes to the nozzle, such that when the screw holes of the first and second lock plates are mutually aligned, the apertures of the first and second lock plates are offset and act to deform and lock into place the pigment tube.

6. The device of claim 5, wherein the valve is mounted on the mounting plate.

7. The device of claim 5, further comprising:

a cap fixedly mounted under the nozzle in the dormant position; and a sponge, located in the cap and moistened to provide moisture to the nozzle to prevent drying of pigment located in the nozzle.

8. The device of claim 5, further comprising:

a microprocessor for controlling the actuation of the valve and the movement of the mounting plate and nozzle.

9. The device of claim 5, further comprising:

a plurality of additional pigment reservoirs, valves, and pigment tubes, all similarly arranged, wherein each of the pigment tubes is connected to the nozzle and is locked into place by the first and second lock plates.

10. The device of claim 9, further comprising:

a cap fixedly mounted under the nozzle in the dormant position; and a sponge, located in the cap and moistened to provide moisture to the nozzle to prevent drying of pigment located in the nozzle.

11. The device of claim 9, further comprising:

a microprocessor for controlling the actuation of the valve and the movement of the mounting plate and nozzle.

12. The device of claim 5, further comprising:

a sight having a diameter substantially equal to the nozzle and positioned within the mounting plate such that when the mounting plate is in the dormant position, the sight is positioned at the position of the nozzle when the mounting plate is in the dispensing position.

13. A method of retaining a pigment tube within a nozzle using a pair of lock plates each including pair of attaching locations and an offset aperture in a paint pigment dispensing apparatus, comprising the steps of:

aligning the apertures of the lock plates;

placing the pigment tube through the aligned apertures;

inserting the pigment tube into the nozzle;

aligning the attaching locations of the lock plates;

attaching the lock plates to the nozzle; and creating an offset between the apertures to deform the pigment tube and substantially to prevent its removal from the nozzle.

* * * * *